United States Patent [19]

Inteso

[11] Patent Number: 4,831,753

[45] Date of Patent: May 23, 1989

[54] EMBROIDERY FRAME FOR HATS

[76] Inventor: Ronald N. Inteso, 6311 De Soto Ave., Unit L, Woodland Hills, Calif. 91367

[21] Appl. No.: 242,591

[22] Filed: Sep. 12, 1988

[51] Int. Cl.[4] ..... D06C 3/08

[52] U.S. Cl. ..... 38/102.3; 112/103; 223/DIG. 2; 223/25

[58] Field of Search ..... 38/102.3, 102.91, 102.6, 38/102.1, 102.4, 102.5, 102.7, 102.8, 102; 112/103; 223/DIG. 2, 91, 15, 25, 24

[56] References Cited

U.S. PATENT DOCUMENTS

| | | | |
|---|---|---|---|
| 1,118,858 | 11/1914 | Hiegel | 38/102.91 X |
| 4,438,693 | 3/1984 | Serrianne et al. | 223/24 X |
| 4,491,256 | 1/1985 | Payne et al. | 223/25 |
| 4,598,488 | 7/1986 | Inteso | 38/102.3 |

*Primary Examiner*—Andrew M. Falik
*Attorney, Agent, or Firm*—Rapkin, Gitlin, Moser & Schwartz

[57] ABSTRACT

An embroidery frame having generally rectangular shaped side members and front and back members that define the perimeter of the frame, a clamp that is integrated with and extends across the front member of the frame having ends that attach to the respective side members. A cross member extends across the approximate mid-section of the frame, has ends that attach to the respective side members and includes a plurality of vertically oriented teeth that penetrate and hold a section of the fabric of the hat to assist in drawing taut the working area that is to be embroidered or monogrammed. The cross member is slideably adjusted along the length of the frame and is adapted to be fixed securedly to the side members when the hat is being monogrammed or embroidered. Incorporated in the frame and mounted at the approximate mid-section of the front member is a curved rod member, which is attached to a lever assembly that permits the rod to be lowered and lifted from the working area. The rod, when lowered by the lever assembly and locked into position, is most effective in drawing the working area taut and flat to permit a distortion free and high quality embroidery or monogram.

1 Claim, 1 Drawing Sheet

EMBROIDERY FRAME FOR HATS

BACKGROUND OF THE INVENTION

1. Field of the Invention

The present invention relates generally to the field of embroidery and monogramming and more particularly to an improvement of a device used in conjunction with a machine for embroidering and monogramming hats and similar items of apparel.

2. Description of the Prior Art

Computerized multi-head embroidery and monogramming machines are now commonplace and used extensively in the apparel and related industries. Specifically, computerized embroidery or monogram machines are used for embroidering and monogramming a variety of items, including shirts, pants, sweaters, handkerchiefs, towels and hats, to name just a few. Conventionally shaped flat surface embroidery racks or frames are adaptable to machines that embroider or monogram most types of articles. Articles can now be laid flat and easily drawn taut to allow for a distortion free and high quality monogram or embroidery. Hats, such as baseball caps, exhibit a special problem when attempts are made to monogram or embroider them using flat surface framing techniques. The difficulty has been in the inability to lay the area to be embroidered or monogrammed flat and taut and maintain it that way during the entire procedure. The usual result is a puckered or distorted embroidery, a problem normally associated with efforts to flatten a curved shape or surface.

The invention disclosed in U.S. Pat. No. 4,598,488 specifically solves the problem described above. However, there are several drawbacks associated even with this device that demand a solution in order to produce a more efficient embroidery method and better quality product. In the patented invention referred to above, L-shaped clips are inserted adjacent to the front edge of the working area of the hat surface (along the rear of the bill section) to draw that area taut in order to minimize distortion during the embroidery or monogramming process. Because of their design and number, it is often difficult to place and maintain the clips fixed in the proper position. The clips are also a bit cumbersome to work with and because of their relatively small size are easy to lose. The clips also have a tendency, if they are allowed to grip the working surface too tightly, to cause indentations or tears in the body of the fabric.

To solve these problems an improvement has been devised that will replace the clips and allow for a much superior job of embroidering or monogramming in the process. The improvement is a curved rod attached to the front section of the frame and operable in a direction towards and away from the working area by a lever assembly incorporated therewith. The improved invention is a simple mechanism that produces a much better result than other devices of its type, while avoiding all the drawbacks usually associated with the prior art devices, such as the one described previously.

The advantages and distinctions of the present invention over the prior art will become clearly evident in the following disclosure.

SUMMARY OF THE INVENTION

The present invention in its preferred embodiment comprises an embroidery frame having generally elongated rectangular shaped side members and front and back members that are connected thereto and define the perimeter of the frame and a clamp that is integrated with and extends across the front member of the frame having ends that attach to the respective side members. Also included in the frame is a cross member that extends across its approximate mid-section and having ends that are attachable to the respective side members. The cross member also includes a plurality of vertically oriented teethlike protrusions that penetrate and hold a section of the back of a hat or similar item of apparel to assist in drawing the working area taut so that it may be embroidered or monogrammed. The cross member is also slideably adjusted along the length of the frame, but is adapted to be fixedly secured to the side members when the hat is mounted to the frame and in the process of being monogrammed or embroidered. The frame is constructed so that it may easily be mounted to a pantograph.

Mounted at the approximate mid-section of the front member of the frame is a curved rod member, which is attached to a lever assembly that permits the rod to be lowered and lifted from the perimeter of the working area. The rod, when lowered by the lever assembly and locked into position, is most effective in flattening and drawing the working area taut to permit a distortion free and high quality embroidery or monogram.

The primary object of the present invention is to provide an improvement of an embroidery frame or fixture that permits effective distortion free embroidering or monogramming on hats and related items of apparel.

Another object of the present invention is to provide an improvement of an embroidery frame or fixture that facilitates the mounting and demounting of a hat or similar item of apparel during or in connection with the embroidering or monogramming process.

Another object of the present invention is to provide an improvement of an embroidery frame or fixture that is convenient to use and inexpensive to manufacture.

Still another object of the present invention is to provide an improvement of an embroidery frame or fixture that produces a much higher quality embroidered or monogrammed product than those produced by the prior art devices.

Yet still another object of the present invention is to provide an improvement of an embroidery frame or fixture that is simple in design and safer to use than the prior art devices.

Yet still another object of the present invention is to provide an improvement of an embroidery frame or fixture that minimizes and in most instances eliminates the risk of damage to the fabric of hats and similar items of apparel during the embroidering or monogramming process.

Other objects and advantages will become apparent in the following specifications when considered in light of the attached drawings wherein a preferred embodiment of the invention is illustrated.

DETAILED DESCRIPTION OF THE PREFERRED EMBODIMENT

Figure 1:
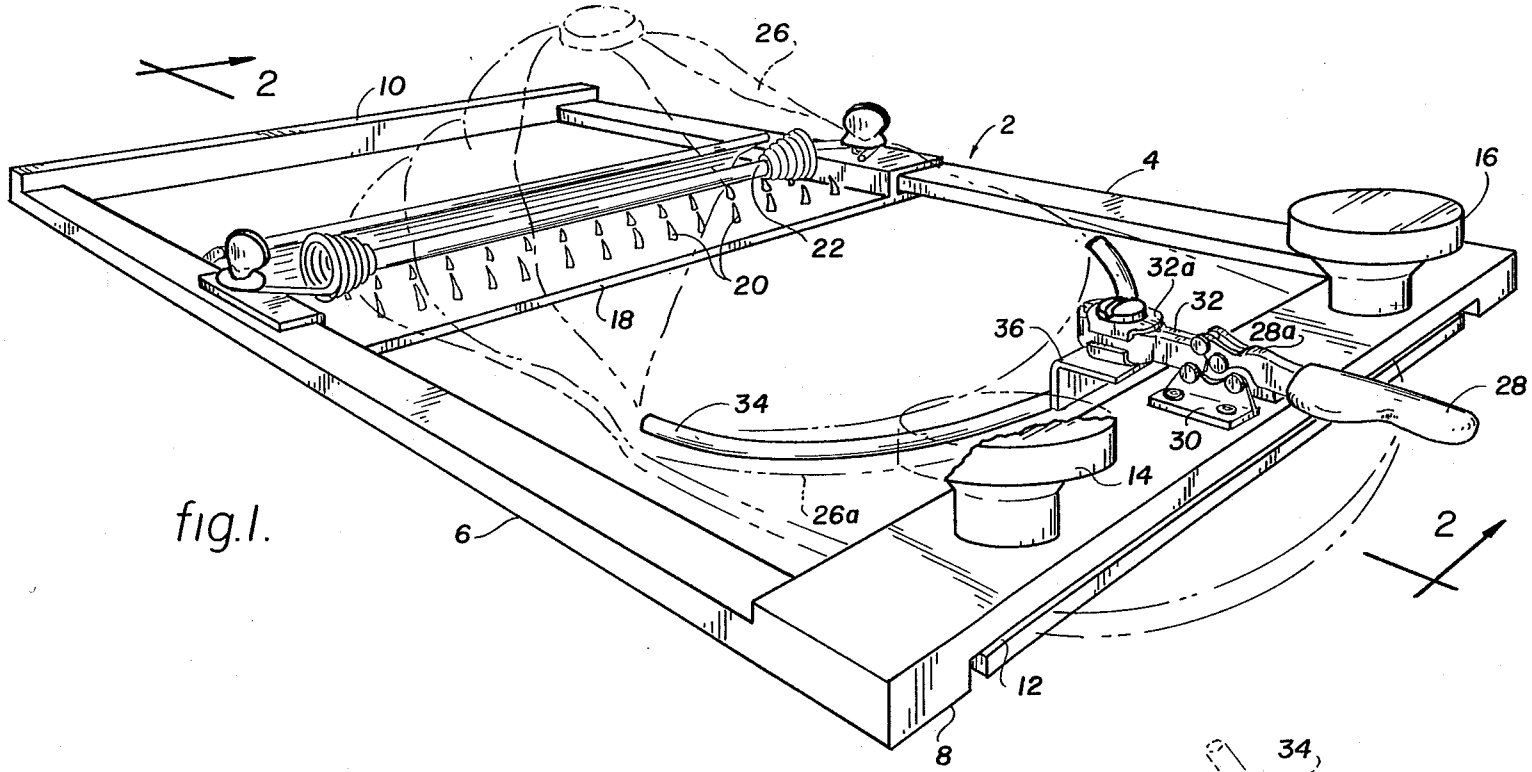
FIG. 1 is a perspective view of the improved frame of the present invention with a baseball type cap mounted thereon.
Figure 2:
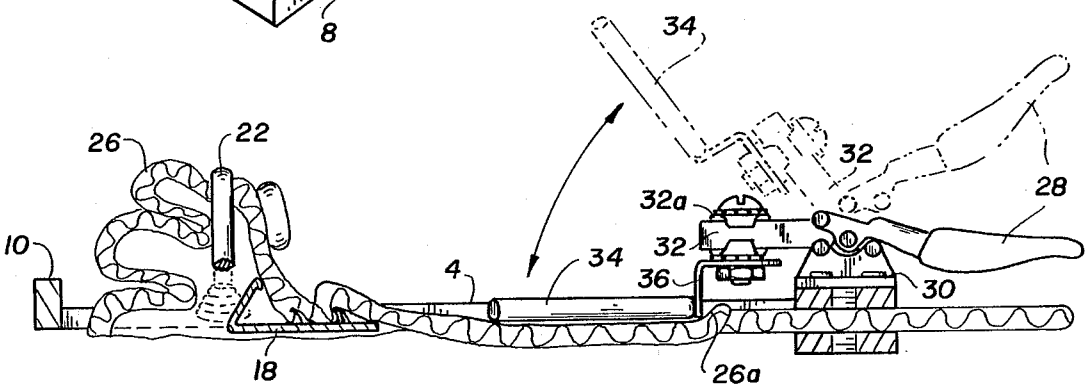
FIG. 2 is a view of the improved frame of the present invention shown along line 2—2 of FIG. 1.

Referring now in greater detail to the improved embroidery frame of the present invention and with particular reference to the embodiment illustrated in the drawings, frame 2 is constructed of any conventional material, such as, for example, a metal allow or fiberglass and is generally rectangular in shape. Frame 2 includes side members 4 and 6 and respective front and rear members 8 and 10 joined together in any conventional manner. Member 12 is adapted to fit beneath front member 8 to form a clamp mechanism and is joined together therewith by fasteners 14 and 16. When fasteners 14 and 16 are turned together in a clockwise direction the clamp is tightened. When fasteners 14 and 16 are turned together in a counter-clockwise direction the clamp is loosened. Cross member 18 extends across the width of frame 2 at approximately the mid-section thereof and is supported at its ends by side members 4 and 6, respectively. Cross member 18 contains a plurality of generally vertically extending teeth 20 that are disposed along its upper surface. Cross member 18 is slideably adjustable along the longitudinal axes of side members 4 and 6 and is fixedly securable thereto. Elastic member 22 is attachable at its ends to side members 4 and 6, respectively, and extends across the width of frame 2 in close proximity to and in parallel relation with cross member 18. Mounted on the upper surface of front member 8 is a lever assembly attached to front member 8 by a bracket 30. The lever assembly is comprised of several principal elements, including a handle 28, an arm **28*a* integrally formed with and extending from handle 28, a second arm 32, which is pivotally attached to arm 28*a*, an L-shaped bracket 36, which is affixed to second arm 32 by an attachment means 32*a*, and a curved rod 34, which is affixed to the opposite end of L-shaped bracket 36**.

In practice, frame 2 is mounted to a pantograph (not shown) by using any appropriate fastening means. Hat 26 is placed within the frame 2 in the following suggested manner. Hat bill **26*a* is inserted within the clamp and between members 8 and 12. Hat 26 is then secured firmly with the clamp therein by turning fasteners 14 and 16 together in a clockwise direction. The rear section of hat 26 is then tightly pulled in the direction of rear member 10 and lifted onto teeth 20, which then penetrate the fabric and hold the rear section of hat 26 firmly in place. Elastic member 22 is then positioned over the top of the cap section of hat 26 to assist in securing that portion of hat 26 firmly in place. To create a taut and substantially flattened working area, handle 28, which is usually at this stage in the process in an elevated position, is depressed and locked firmly into place. The downward movement of handle 28 precipitates the simultaneous downward movement of arms 28*a*, 32 and most importantly, rod 34, which is brought firmly and securely into contact with the perimeter of the working area at the rear of brim 26*a*. The curved shape and size of rod 34, which coincides with the shape of the rounded rim of the cap, along with the constant pressure maintained by the action of the locked lever assembly, makes it possible for a maximum degree of tautness around the working area resulting in a more efficient operation and an extremely high quality product. When the embroidering or monogramming process is complete, handle 28 is uplifted to cause rod 34 to raise up from the perimeter of the working area. Hat 26** is then easily removed from the frame by reversing the mounting process, as described above.

While the invention will be described in connection with a certain preferred embodiment it is to be understood that it is not intended to limit the invention to that particular embodiment. Rather, it is intended to cover all alternatives, modifications and equivalents as may be included within the spirit and scope of the invention as defined by the appending claims.

I claim:

1. A device for use in conjunction with a machine for embroidering and monogramming hats, which includes a frame, said frame being generally rectangular in shape and comprising first and second side members joined at their ends to the corresponding ends of front and back members thereof; a first means to secure the back section of a hat to said frame, said first means including a cross member having ends that are lockably connected to said first and second side members, respectively, in slidable relation therewith, said cross member containing a plurality of generally vertically extending teeth disposed along the upper surface thereof for penetrating the fabric and securing the back section of said hat during the process of embroidering or monogramming; and the improvement comprising a second means to secure the front section of a hat to said frame, said means comprising a clamp, including a top and bottom section, and a means to stretch and maintain taut the section of said hat to be embroidered or monogrammed, said means including a lever means, an arm member pivotally attached thereto and a curved shaped rod member attached to said arm member so that when said lever is raised, the rod member lifts simultaneously from said hat and when said lever is depressed, said rod member is depressed into contact relation with said hat to draw the fabric of said hat taut and flat to enable the application of the embroidery or monogram thereto.

* * * * *